US010688335B1

(12) United States Patent
Maher

(10) Patent No.: US 10,688,335 B1
(45) Date of Patent: Jun. 23, 2020

(54) EXERCISE DEVICE

(71) Applicant: Lyn Steven Maher, West Hills, CA (US)

(72) Inventor: Lyn Steven Maher, West Hills, CA (US)

( * ) Notice: Subject to any disclaimer, the term of this patent is extended or adjusted under 35 U.S.C. 154(b) by 0 days.

(21) Appl. No.: 16/355,331

(22) Filed: Mar. 15, 2019

Related U.S. Application Data

(60) Provisional application No. 62/644,364, filed on Mar. 16, 2018.

(51) Int. Cl.

| | |
|---|---|
| ***A63B 21/00*** | (2006.01) |
| ***A63B 23/02*** | (2006.01) |
| ***A63B 23/12*** | (2006.01) |
| ***A63B 24/00*** | (2006.01) |
| ***A61H 1/00*** | (2006.01) |

(52) U.S. Cl.
CPC ..... *A63B 21/4033* (2015.10); *A61H 1/005* (2013.01); *A63B 21/00058* (2013.01); *A63B 21/4035* (2015.10); *A63B 21/4037* (2015.10); *A63B 23/0205* (2013.01); *A63B 23/1236* (2013.01); *A63B 24/0087* (2013.01); *A63B 21/00047* (2013.01); *A63B 2208/0261* (2013.01); *A63B 2225/09* (2013.01); *A63B 2225/50* (2013.01)

(58) Field of Classification Search
CPC ..... A61H 1/005; A63B 21/00058; A63B 21/4033; A63B 21/4037; A63B 21/4035; A63B 21/00047; A63B 23/0205; A63B 23/1236; A63B 24/0087; A63B 2225/50; A63B 2225/09; A63B 2208/0261
See application file for complete search history.

(56) References Cited

U.S. PATENT DOCUMENTS

| | | | | |
|---|---|---|---|---|
| 5,125,650 | A * | 6/1992 | Paris | A63B 21/00047 482/140 |
| 9,211,440 | B2 * | 12/2015 | Lagree | A63B 24/0087 |
| 9,370,679 | B2 * | 6/2016 | Lagree | A63B 23/0233 |
| 9,545,535 | B2 * | 1/2017 | Lagree | A63B 21/023 |
| 2007/0270726 | A1 * | 11/2007 | Chou | A61H 23/0263 601/70 |
| 2013/0150219 | A1 * | 6/2013 | Chang | A61H 1/0229 1/229 |
| 2014/0128231 | A1 * | 5/2014 | Menaker | A63B 21/00047 482/145 |
| 2018/0117388 | A1 * | 5/2018 | Porter | A63B 21/4033 |
| 2018/0126215 | A1 * | 5/2018 | Ho | A63B 21/4049 |

* cited by examiner

*Primary Examiner* — Megan Anderson
(74) *Attorney, Agent, or Firm* — Colin P. Abrahams

(57) ABSTRACT

An exercise apparatus comprises a base frame including a base frame connector. A movable frame including a movable frame connector is provided, and the movable frame connector is connected to the base frame connector such that the movable frame is rotatable relative to the base frame. An actuator is located between the base frame and the movable frame, and the actuator moves the movable frame relative to the base frame about the base frame connector so as to position the movable frame relative to the base frame in a selected position.

17 Claims, 23 Drawing Sheets

EXERCISE DEVICE

CROSS-REFERENCE TO RELATED APPLICATIONS

This application claims the benefit of U.S. Provisional Patent Application No. 62/644,364 filed Mar. 16, 2018, the contents of which are incorporated herein by reference in their entirety.

FIELD AND BACKGROUND OF THE INVENTION

This invention relates to an exercise device or apparatus. More particularly, the invention relates to an exercise device or apparatus which may be motorized. The exercise apparatus, whether motorized or not, has parts and components which are adjustable relative to each other, so that a user may configure the exercise apparatus according to the level of difficulty desired by the user, or dictated by the user's physical fitness level and condition.

Some of the best body strengthening exercises are the push-up and the plank exercises. Traditionally, however, these need to be done on the floor. At this horizontal position, the exercises may be very difficult for many people, and, at this angle, it may place considerable pressure on the wrists and shoulders. After the exercise is completed, it is necessary to get up off the floor, another movement which may be difficult for many people.

SUMMARY OF THE INVENTION

According to one aspect of the invention, there is provided an exercise apparatus comprising: a base frame including a base frame connector; a movable frame including a movable frame connector, the movable frame connector being connected to the base frame connector such that the movable frame is rotatable relative to the base frame; and an actuator located between the base frame and the movable frame, the actuator moving the movable frame relative to the base frame about the base frame connector so as to position the movable frame relative to the base frame in a selected position.

In one embodiment, the base frame comprises a substantially U-shaped tubular frame having two ends, a substantially vertical post extending upwardly from each end, the base frame connector being located at each of the ends. Further, the base frame further may comprise a front cross piece near one end thereof, and an intermediate cross piece, the actuator being connected to the base frame at the intermediate cross piece thereof.

Preferably, the movable frame comprises a substantially U-shaped tubular frame having two ends, the movable frame connector being located at each of the ends. The movable frame may comprise a cross piece extending across the movable frame, the actuator being connected to the movable frame at the cross piece thereof.

In one embodiment, the actuator comprises a telescoping extender positioned between the movable frame and the base frame, the actuator comprising a housing and a telescoping portion which selectively projects from or is contained within the housing, and wherein the position of the telescoping portion relative to the housing determines the angular position of the movable frame relative to the base frame. The actuator may be operated by a motor. Further, a remote control device may be provided for selectively activating the motor. The device may include a power source for the motor, the power source being selected from one or more of a battery, an external AC power source, or a combination thereof.

In one embodiment, a platform is mounted on the movable frame, the platform providing a substrate for supporting a user of the exercise apparatus. There may be at least one arm rest mounted on the platform. Further, there may be at least one handle mounted on the platform. Additionally, the invention may comprise a mat for positioning adjacent the exercise apparatus, and connection means for releasably securing the mat to the base frame of the exercise apparatus. It should be noted that the armrest as well as the handle may be attached to the platform in any suitable manner, including the use of Velcro.

The exercise apparatus of the invention may also include and incorporate a vibration motor, as seen in FIG. 26, which may be attached thereto, such as, for example, at the back of the platform. The presence of such a vibration motor has the added benefit of providing the option for vibration training. The vibration motor is in one embodiment preferably attached to the approximate center of the back of the platform, although other attachment positions may be used, and selectively activated by the user when desired. Different degrees or levels of vibration can be achieved.

Preferably, the movable frame can be angularly positioned and fixed at a selected angle relative to the base frame.

According to a further aspect of the invention, there is provided a method for exercising comprising: positioning a base frame including a base frame connector on a substantially flat surface; providing a movable frame including a movable frame connector, such that the movable frame connector is connected to the base frame connector and the movable frame is rotatable relative to the base frame; locating an actuator between the base frame and the movable frame, the actuator moving the movable frame relative to the base frame about the base frame connector; and positioning the movable frame relative to the base frame in a selected position.

This invention therefore relates to a device or apparatus, the apparatus having adjustable relative positions. The apparatus may be moved between such adjustable relative positions by means of a motor, and the different selectable positions are determined by a user based on his requirements for a workout. Different positions of the exercise apparatus result in different degrees of difficulty for performing tasks on the apparatus.

In one aspect, the exercise device is one which makes it easier to do push-ups, the plank, as well as other exercises. The device includes a platform that a user can lean on while doing exercises. The device further comprises a pair of frames, to be described more fully below, which move relative to each other, and adjuster members, or actuators, for configuring the pair of frames relative to each other and fixing them in a desired position. The adjuster members may be motorized.

Each adjuster member may have an associated motor for activating the adjuster member, and such motors may be controlled remotely. In one form of the invention, the adjuster members may comprise a pair of actuators, and these may be in the form of pneumatic or hydraulic devices, or electrically powered device which may include a rotating and telescoping screw, extending between the two frames, so that the frames can be moved closer or further apart from each other by appropriately activating these electric motors, or the pneumatic or hydraulic devices.

The selection of the relative position between the two frames determines the degree of difficulty for which an exercise may be carried out. The ability to select such relative positions offers the user the ability to control the difficulty of his or her exercise.

Therefore, in one aspect, the invention provides an easier and stationary position to perform exercises which, without the apparatus of the invention, may have been too difficult for certain sectors of the population to carry out. Another aspect of the invention is that the ability to change relative positions of the pair of frames allows the user to configure the pair of frames so that the exercise is easier initially, but can be made incrementally more difficult as the user acquires more strength over time.

The apparatus of the invention allows persons to exercise at preferred and more compatible positions, based on the persons physical strength and condition. Whereas such exercises may have previously been carried out on a floor or flat surface, the exercise apparatus of the invention allows the user to carry out such exercises while standing or at least on his or her feet on an angled platform, the angle being adjustable based on current needs.

DETAILED DESCRIPTION OF THE INVENTION

Figure 1:
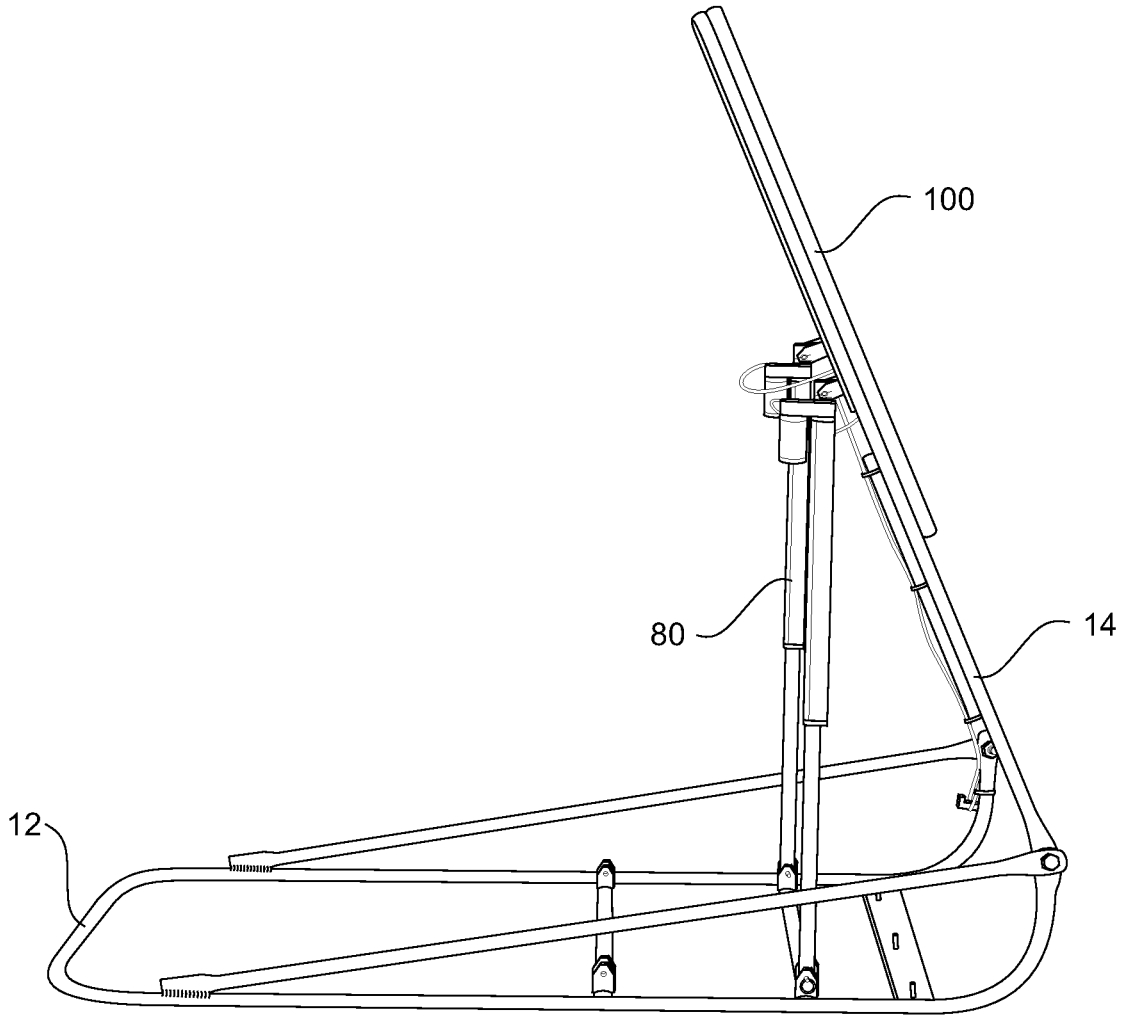
FIG. 1 is a side perspective view of an exercise apparatus in accordance with the invention, shown in the near upright position.

Reference is now made to the accompanying drawings, which show various embodiments and positions of an exercise device 10 in accordance with the present invention.

The exercise device 10 comprises a lower fixed frame 12, and an upper adjustable frame 14. The lower frame 12 and the upper frame 14 are connected to each other at a pair of pivot points 16 and 18, and the upper frame 14 is able to rotate or pivot about the pivot points 16 and 18 so that its position can be adjusted and varied relative to the lower frame 12.

The lower frame 12 comprises a pair of base frames 20, each having a substantially vertical post 22 at one end thereof. Each post 22 has a flattened end 24 with an aperture 26 therein. The lower frame further comprises a pair of ascending bars 30 which extend from near the back of the base frames 20 to the post 22. These bars 30 provide additional strength and stability to the lower frame 12. The lower frame 12 further comprises a rear cross piece 34.

The lower frame 12 further comprises a front cross piece 36. There is also provided an intermediate cross piece 38 between the base frames 20, and the intermediate cross piece 38 has near each end thereof a pair of upwardly directed plates 40 defining a small space 42 between them.

The upper frame 14 comprises a U-shaped tube 48 having a pair of parallel sides 50, and an end 52. A cross piece 54 extends between the sides 50. Each side 50 has a flattened end 56 and an aperture 58. The aperture 26 on the posts 22, and the aperture 58 on the sides 50, register with each other and are secured to each other by a pivot, bolt, or other hardware, so that the upper frame 14 can rotate about the pivot relative to the lower frame 12.

The cross piece 54 has extending somewhat downwardly therefrom a pair of plates 60 near each end thereof, each pair of plates 60 defining a space 62. The function of these plates 60 will be described below.

A pair of actuators 80 is provided, one on each side of the exercise device 10, whereby the relative positions of the lower frame 12 and the upper frame 14 can be adjusted. The actuator 80 is connected at one end to the cross piece 54, and at its other end to the intermediate cross piece 38. At its upper end, each actuator 80 connects to and is received within the space 62 of the plates 60. At its lower end, each actuator 80 connects to and is received within the space 42 between the plates 40. The connection of the actuators 80 at each end thereof is of the pivotal type, so that the ends of the actuators 80 can rotate or pivot within the respective spaces 42 and 62 of the plates 40 and 60 respectively.

Figure 19:
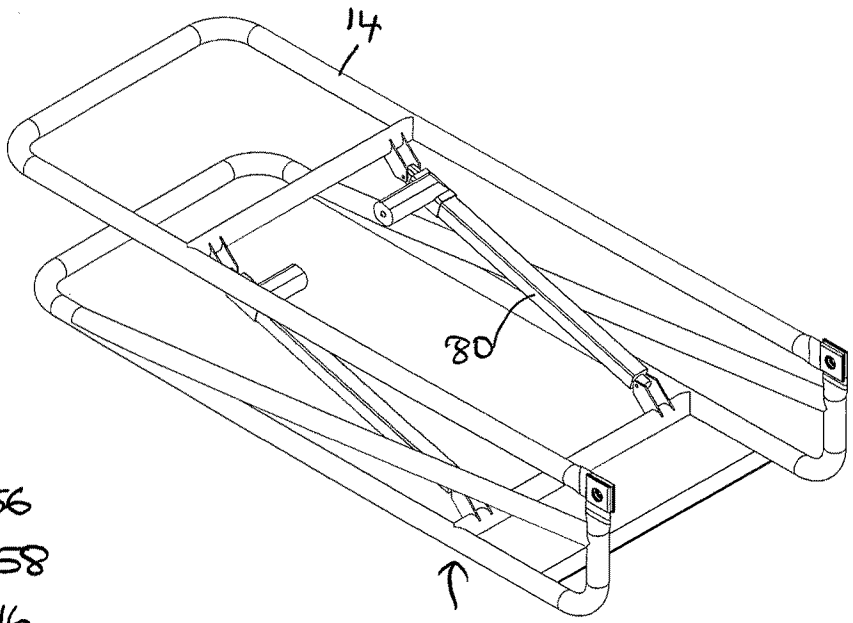
FIG. 19 is a front perspective view of the exercise device of FIG. 18, in the generally horizontal position.
Figure 18:
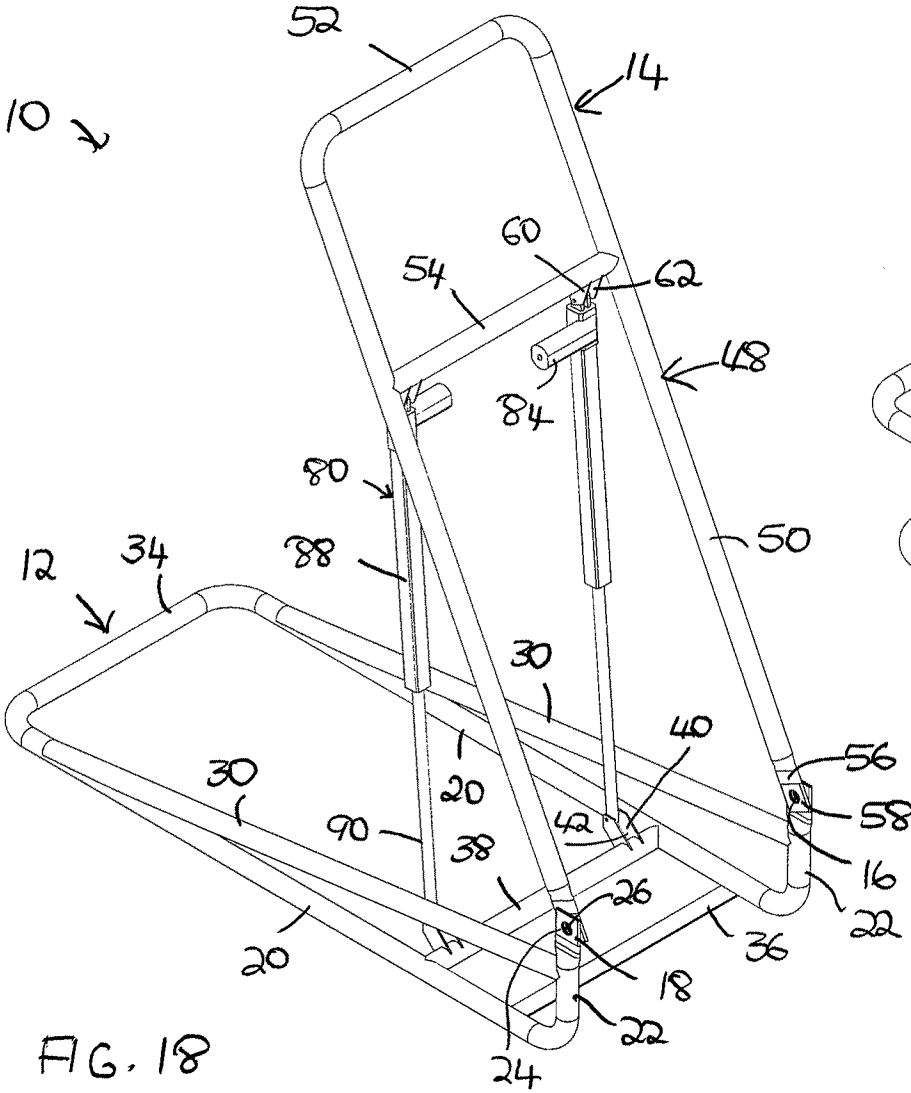
FIG. 18 is a front perspective view of an exercise device in accordance with a further embodiment of the invention, in the generally upright position.

Each actuator 80 may have a motor 84. These motors 84 can be battery-powered, receive power from an electrical household or other outlet, or such other source as may be convenient. Each actuator 80 comprises a housing portion 88, and a telescoping portion 90. The telescoping portion 90 can move into and out of the housing portion 88, and such movement may be hydraulically or pneumatically effected, electrically or electronically, or by electric or manual rotation of a screw in a housing. As will become clear from the drawings, when the telescoping portion 90 telescopes outwardly from the housing portion 88, the lower frame 12 and the upper frame 14 are moved away from each other. Conversely, when the telescoping portion 90 is withdrawn into the housing portion 88, the upper frame 14 is moved toward the lower frame 12. In this way, the upper frame 14 can move between a position in which it is nearly or substantially vertical, and a position in which it is nearly or substantially horizontal. These two opposing positions can clearly be seen in FIGS. 18 and 19 of the drawings respectively.

The upper frame 14 may be positioned relative to the lower frame 12 in any incremental position between the substantially vertical and the substantially horizontal. Therefore, by appropriate control and activation of the motors 84, the actuators 80 will move so that the angle of the upper frame 14 can be suitably selected and fixed in position by simple operation of the user.

There are clear advantages to an exercise device constructed in accordance with the present invention, and operative so as to vary the angle of the upper frame 14. It is well-established, and exercisers and trainers acknowledge, that performing an exercise such as a push-up is more difficult for a person when carrying out that exercise on a flat horizontal surface (see FIGS. 16 and 17). However, it is much easier to perform such exercises when the body is not in the horizontal position. The more vertical the position of the body, the easier it is to do the push-up, or some other appropriate exercise. The exercise apparatus of the invention addresses this very point. A person who, for one reason or another, is not able to carry out push-ups or the plank when in a generally horizontal position, may well be able to do so when pushing away from the upper frame 14 of the exercise device of the present invention. Moreover, the ability to adjust the position of the upper frame 14 relative to the lower frame 12 allows the person to assume more and more difficult positions as he or she becomes fitter and stronger. Therefore, a person may start out using the upper frame 14 in the near vertical position, but over time, and upon gaining strength and fitness, is able to move the upper frame 14 incrementally so that it is at an angle relative to the lower frame, causing the body of the person to become more horizontal.

The exercise apparatus 10 of the invention therefore facilitates and assists in the gradual strengthening of a user, with the ability to make the exercise more and more difficult as strength is gained.

FIG. 1 of the invention shows a side perspective view of the exercise device 10, with the upper frame 14 in a not quite vertical position, but at about an 80° angle. This should be an optimal position for a person starting out, and who still needs to gain strength, and this position can be used until the person is ready for a more difficult or strenuous workout. It will be seen that the upper frame 14 has a platform 100 near the top thereof, providing a solid surface on the upper frame 14 against which the person can lean.

Figure 2:
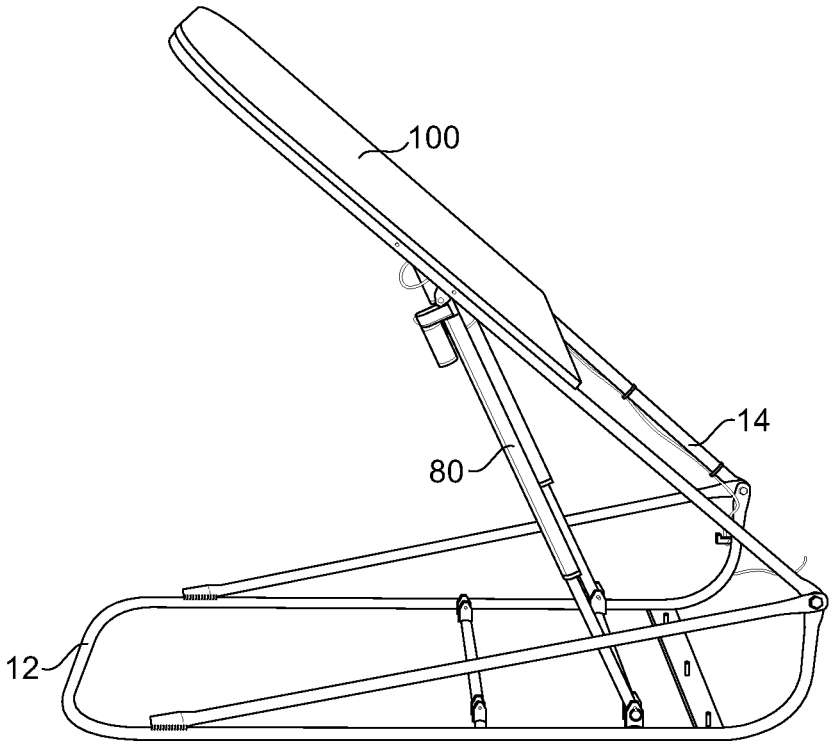
FIG. 2 is a side perspective view of the exercise apparatus at a first inclined position.
Figure 13:
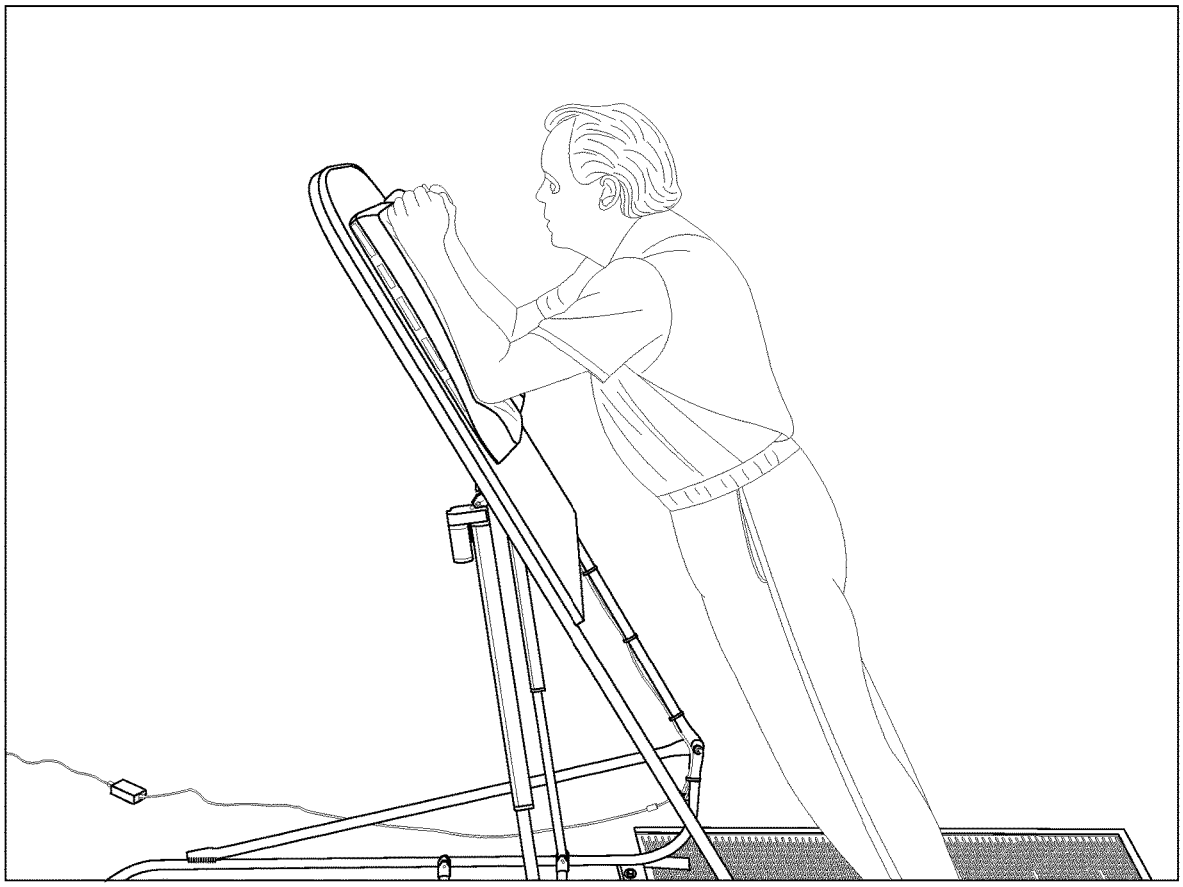
Figure 14:
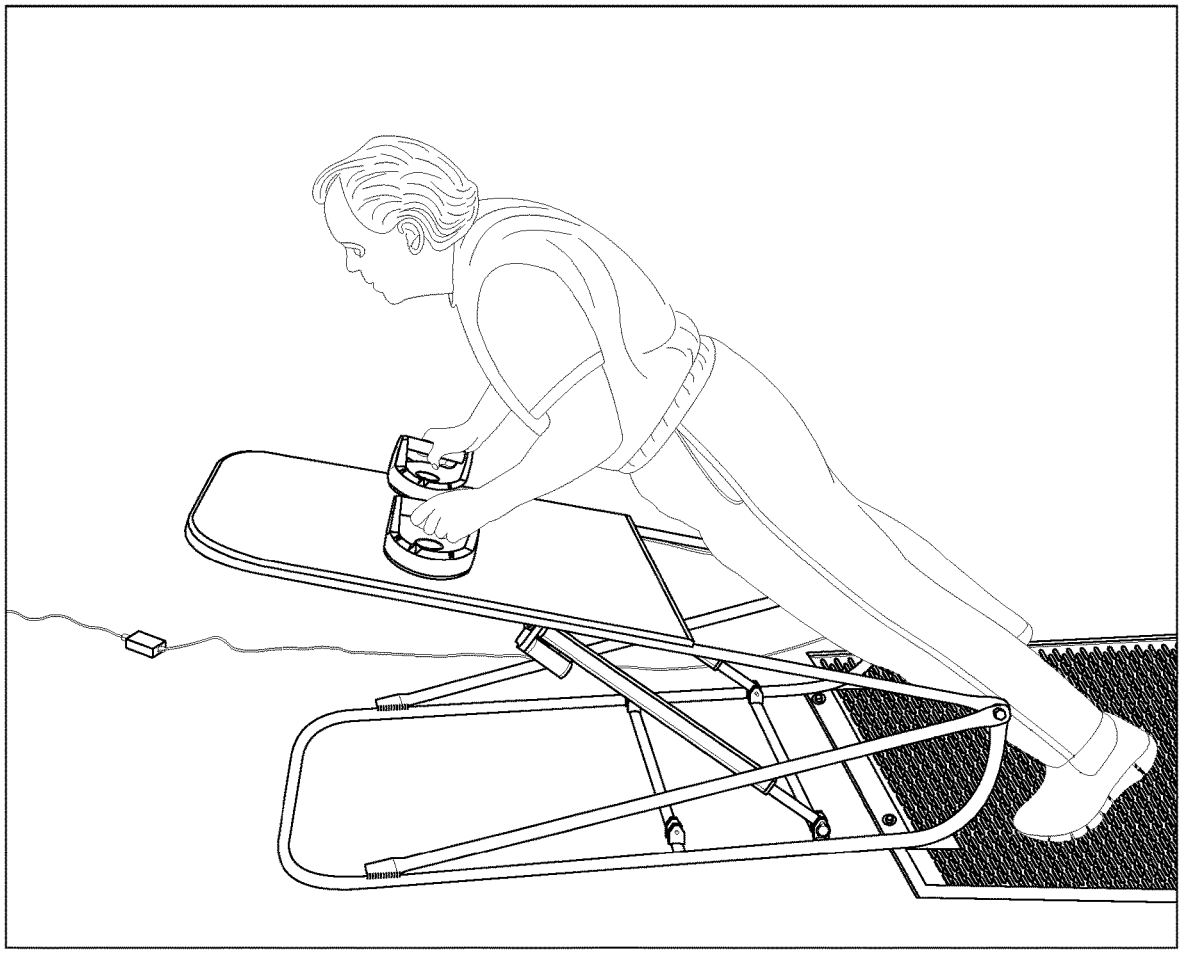

FIG. 2 of the drawings shows a side view of the exercise device 10 in accordance with the invention, wherein the upper frame 14 has been adjusted so that it is at an angle of about 55° relative to the horizontal. FIG. 13 of the invention shows a person exercising on the exercise device when the upper frame 14 is in this position. The person is leaning slightly forward, more so than he would be doing with the upper frame 14 positioned as in FIG. 1. FIG. 2 of the drawings therefore shows the exercise device with the upper frame 14 in a position where the exercise is somewhat more difficult.

Figure 4:
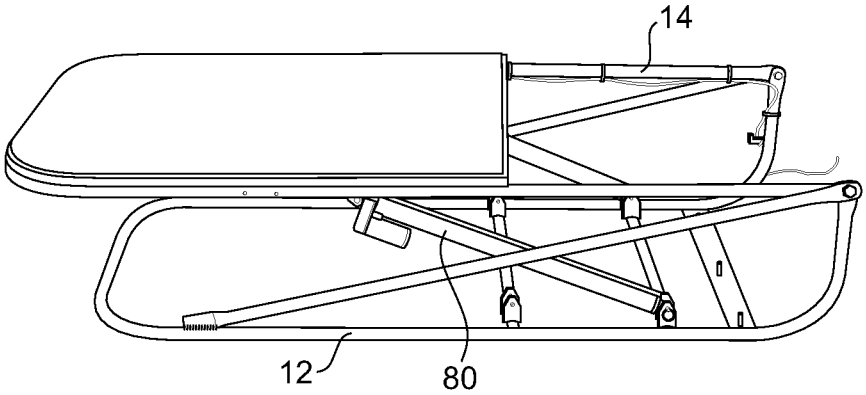
FIG. 4 is a side perspective view of the exercise apparatus in a substantially horizontal position.
Figure 3:
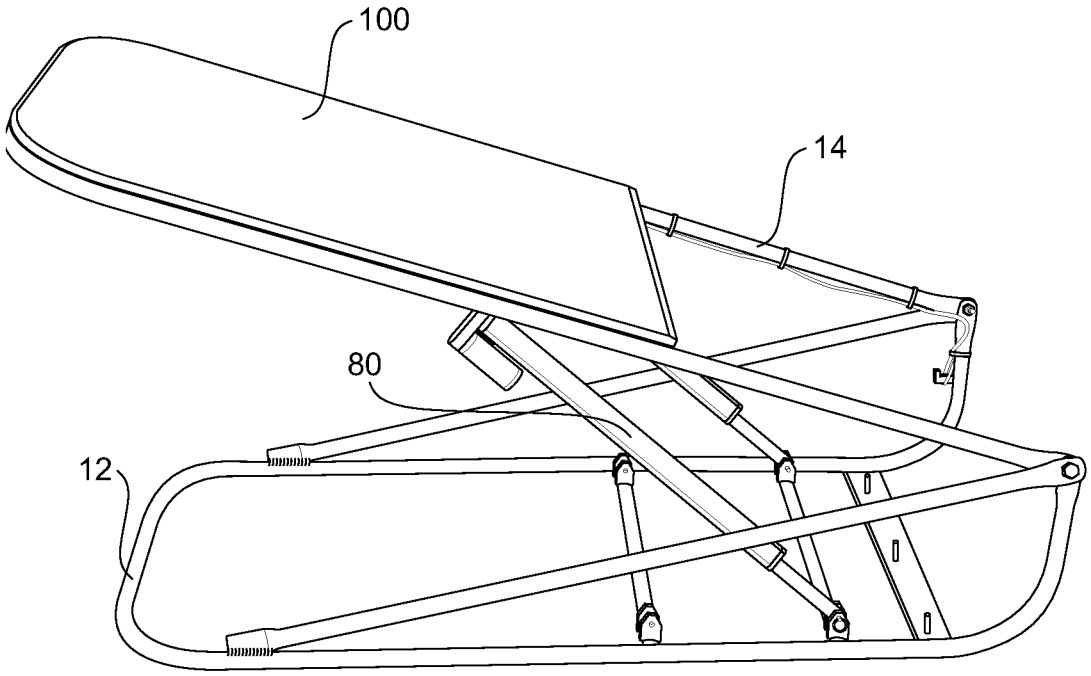
FIG. 3 is a side perspective view of the exercise apparatus in a second inclined position.

FIG. 3 of the drawings shows an exercise device 10 at an angle of about 25° relative to the horizontal. This is more difficult, of course, than the previous two figures, and can be adopted when the user has acquired additional strength. FIG. 4 of the drawings shows an exercise device 10 of the invention at an angle of about 0° relative to the horizontal, and can be used in this configuration when the person exercising has attained even more strength and capability.

Figure 5:
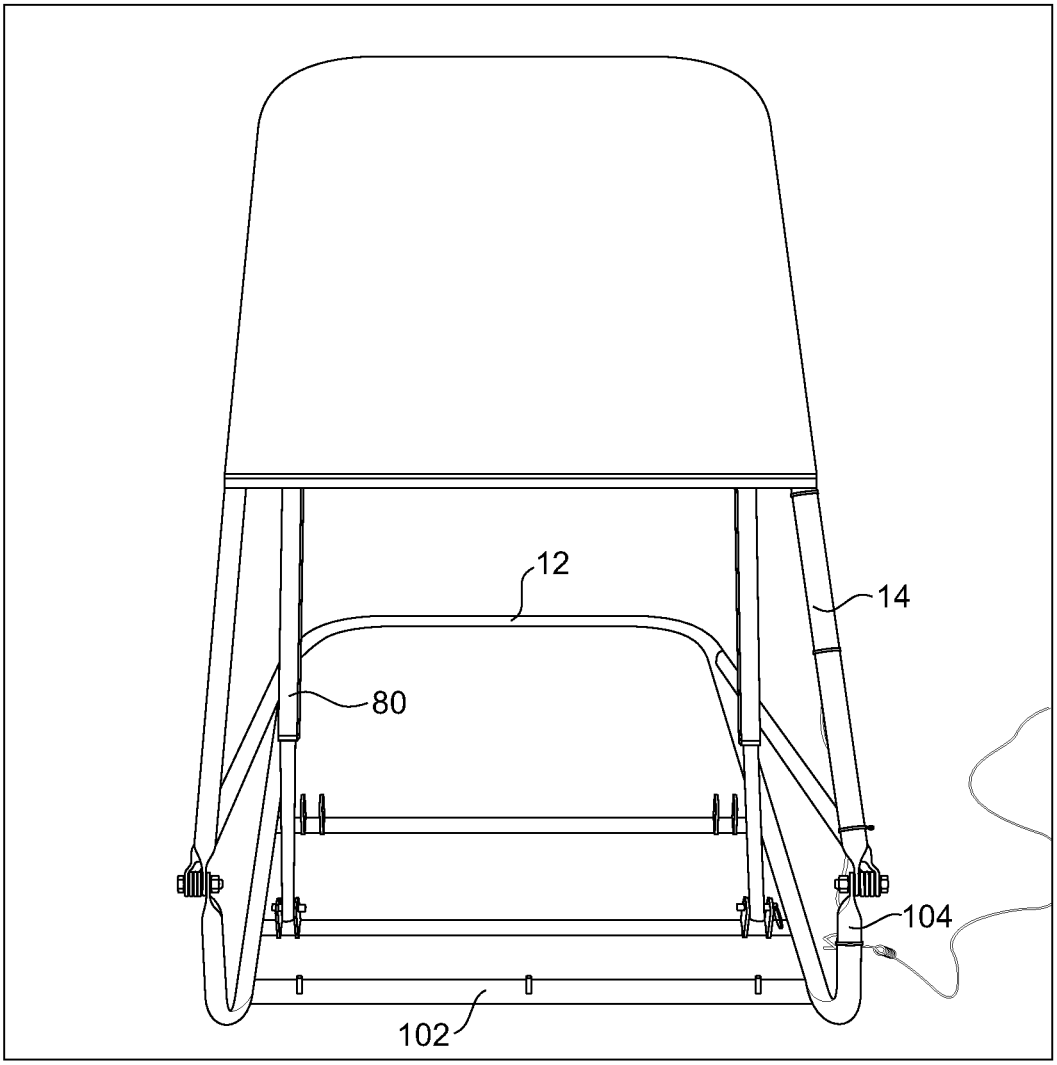
FIG. 5 is a front perspective view of the exercise apparatus of the invention.

FIG. 5 of the drawings shows a front perspective view of an exercise device in accordance with the invention. It can be clearly seen in this figure the position of the platform 100. The user is able to lean on, or grasp, the platform or parts thereof to stabilize herself. FIG. 5 also shows studs 102, which may be used for anchoring a match to the device. Further, an electrical connector 104 is also shown, whereby the exercise device 10 of the invention can be connected to a power source for providing the necessary power to the actuators 80.

Figure 6:
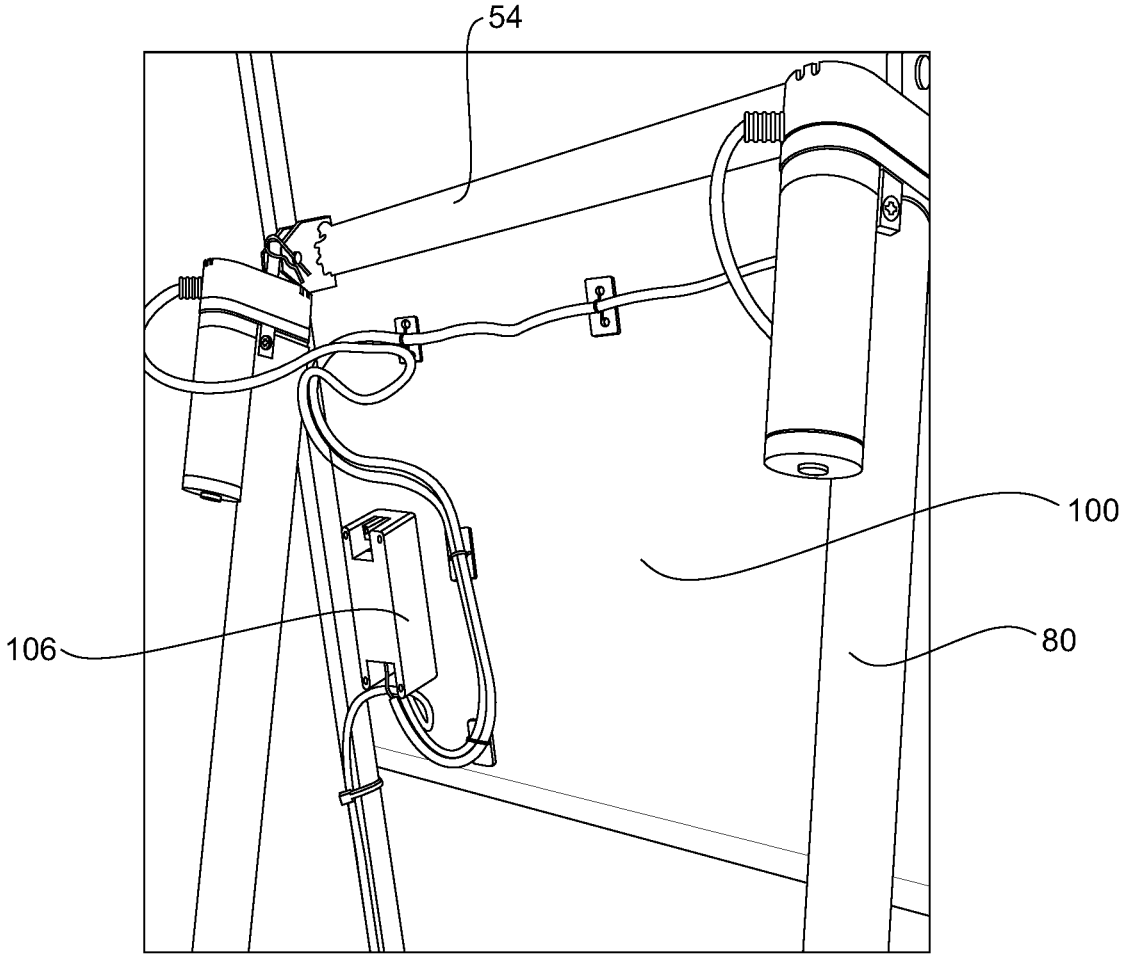
FIG. 6 is a detailed view showing the exercise device with a controller and other features.

FIG. 6 shows a detail of a portion of the exercise device 10, including a controller 106 for operating the motorized actuators, and for receiving instructing signals from a remote control device. As such, simply pressing one or more buttons on a remote device activates the actuators 80, moving the upper frame 14 away from, or toward, the lower frame 12, and which can be stopped at exactly the desired position. The invention may also include provision of preset positions so that a user can rely on a consistent configuration of the exercise device 10 from one session to another.

Figure 7:
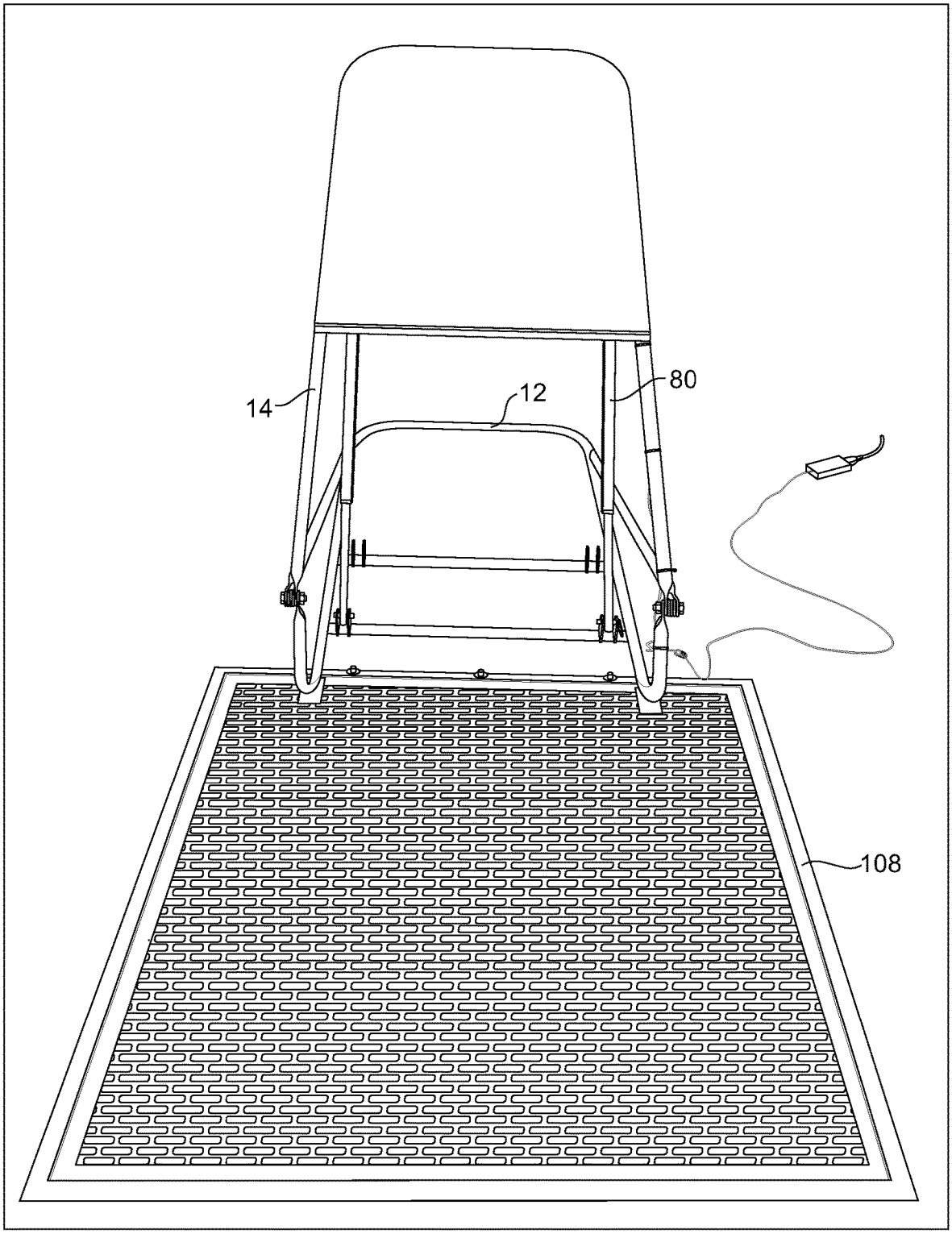
FIG. 7 is a front perspective view of an exercise device including a mat.
Figure 8:
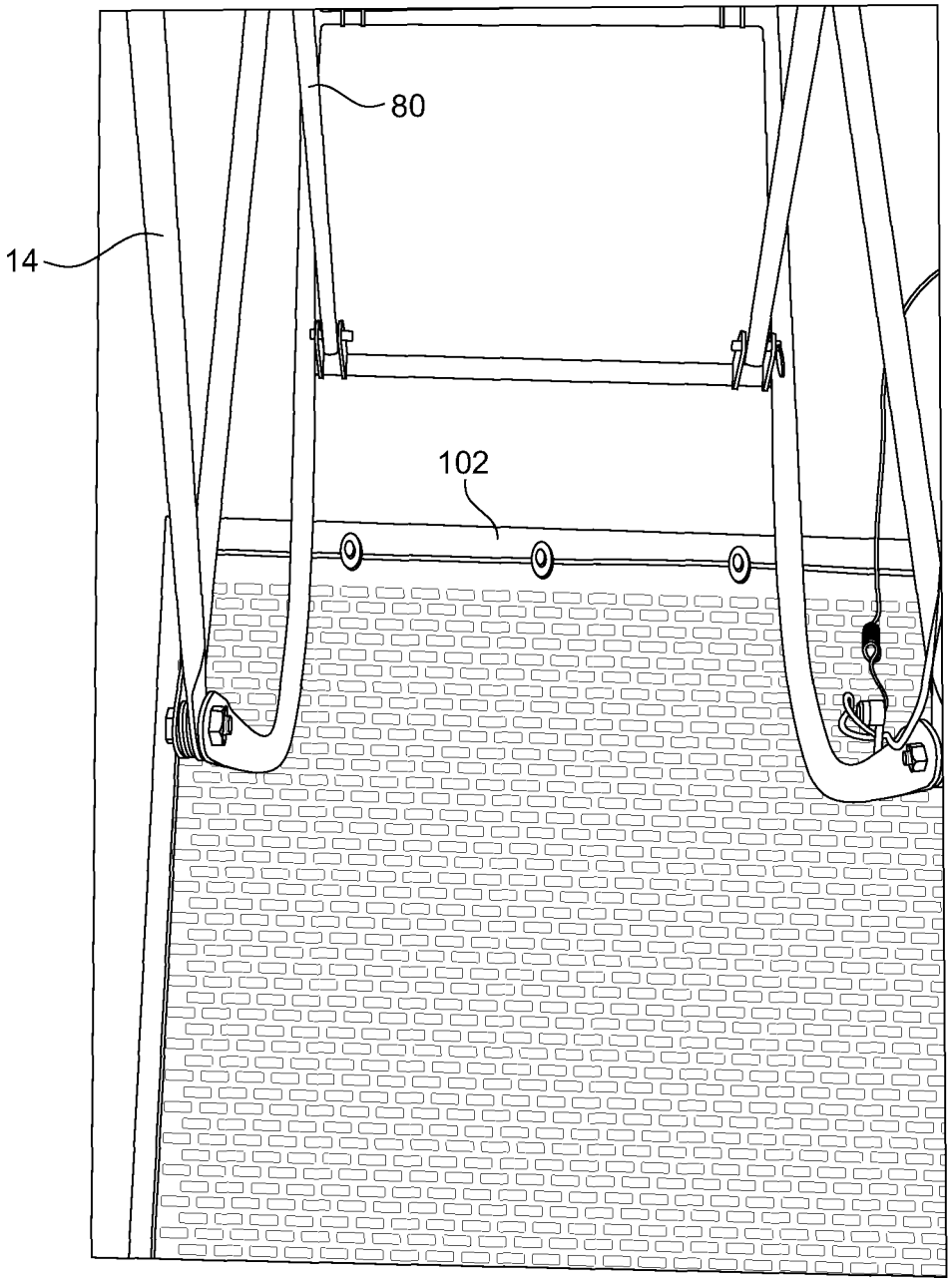
FIG. 8 is a rear view of the exercise device of the invention showing attachment means for the mat.

FIG. 7 of the drawings shows a front view of the exercise device 10 of the invention including a mat 108, which can attach releasably to these studs 102 on the front cross piece 36. The mat will thus be prevented from sliding during exercise. Furthermore, attachment of the matters to the exercise device may also help ensure that the device is not slide away from the user in use. The user's weight, while standing on the mat, helps to keep the device from sliding or moving away. FIG. 8 of the drawings provides a different perspective illustrating apertures or grommet holes in the mat which can be connected to studs 102 of the exercise device 10, and help to prevent slippage of the mat.

Figure 9:
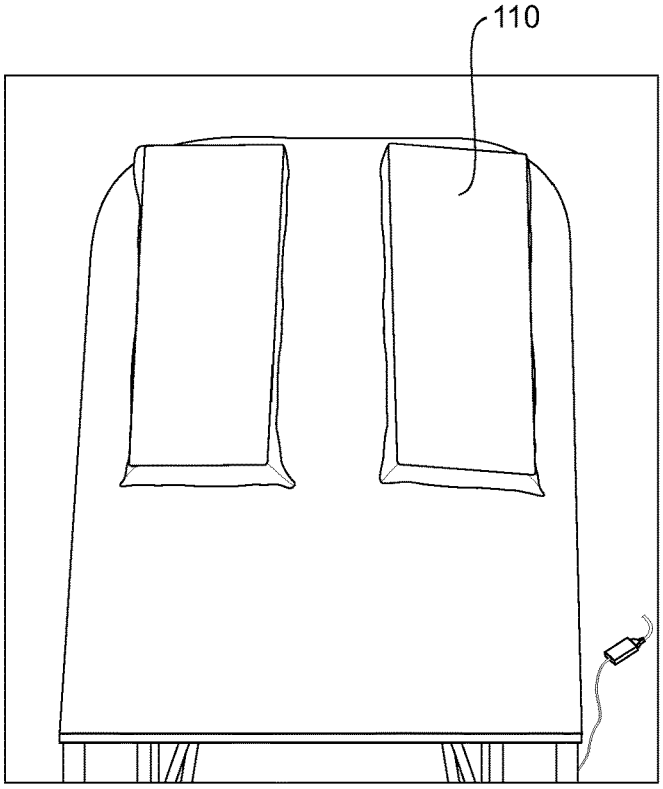
FIG. 9 is a detailed view of the exercise device incorporating armrests.
Figure 10:
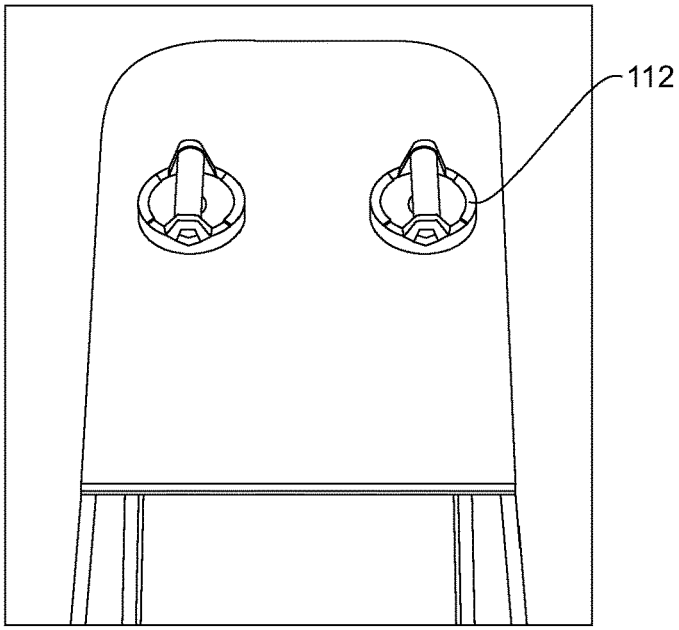
FIG. 10 is a detailed view of the exercise device incorporating handles.

FIG. 9 of the drawings shows a close-up of the platform, including a pair of armrests 110 mounted on the platform. The armrest 110 may be cushioned to provide additional comfort for the user. FIG. 10 of the drawings shows a pair of handles 112 formed on the platform, which can be grasped or held by the person exercising, once again to provide additional stability to the user, and to help keep her centered relative to the exercise device 10.

Figure 11:
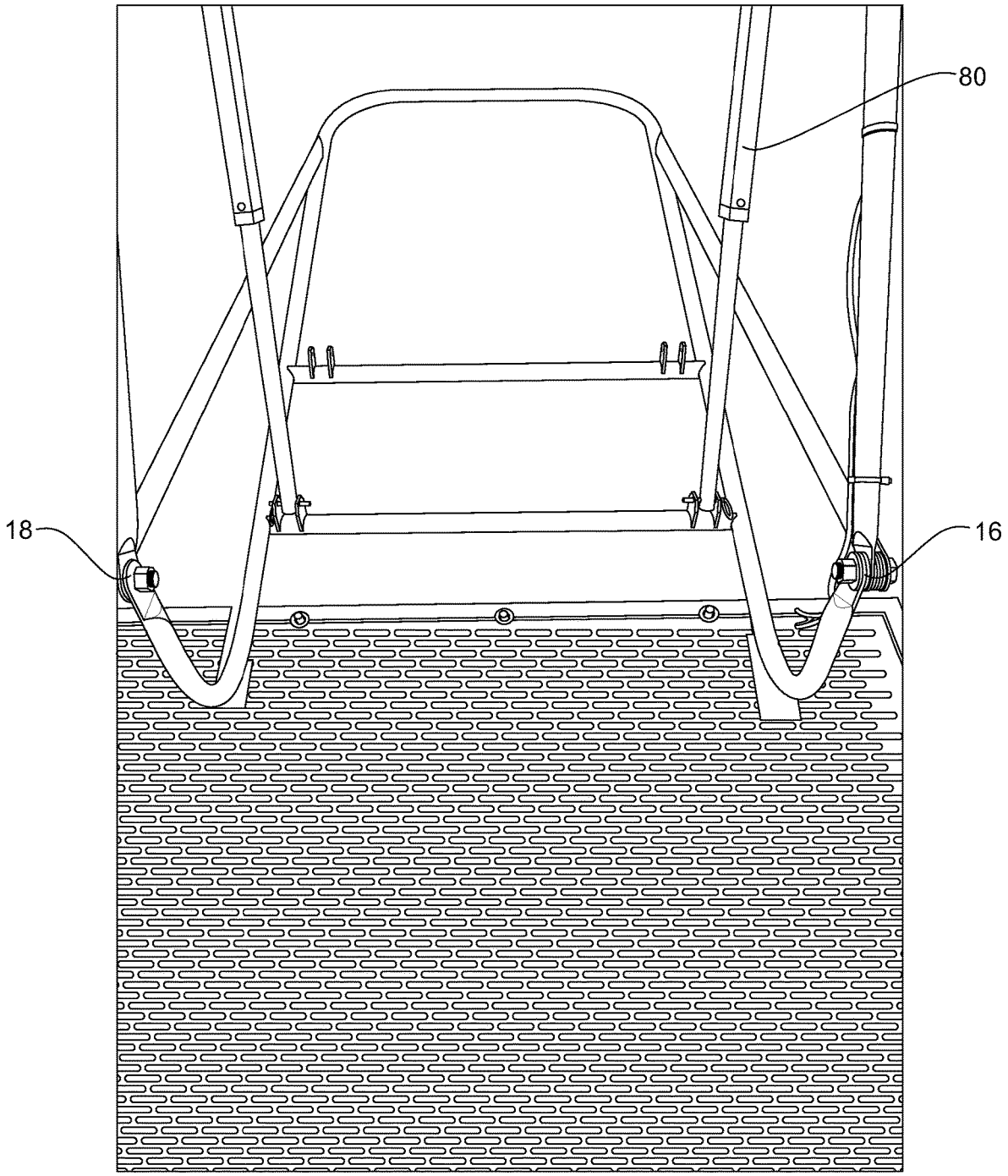
FIG. 11 is a detailed front view of the exercise device illustrating the hinge connectors between frames.

FIG. 11 of the drawings shows an exercise device 10, with a close-up view of the hinge points, or pivots, between the upper frame 14 and the lower frame 12.

Figure 12:
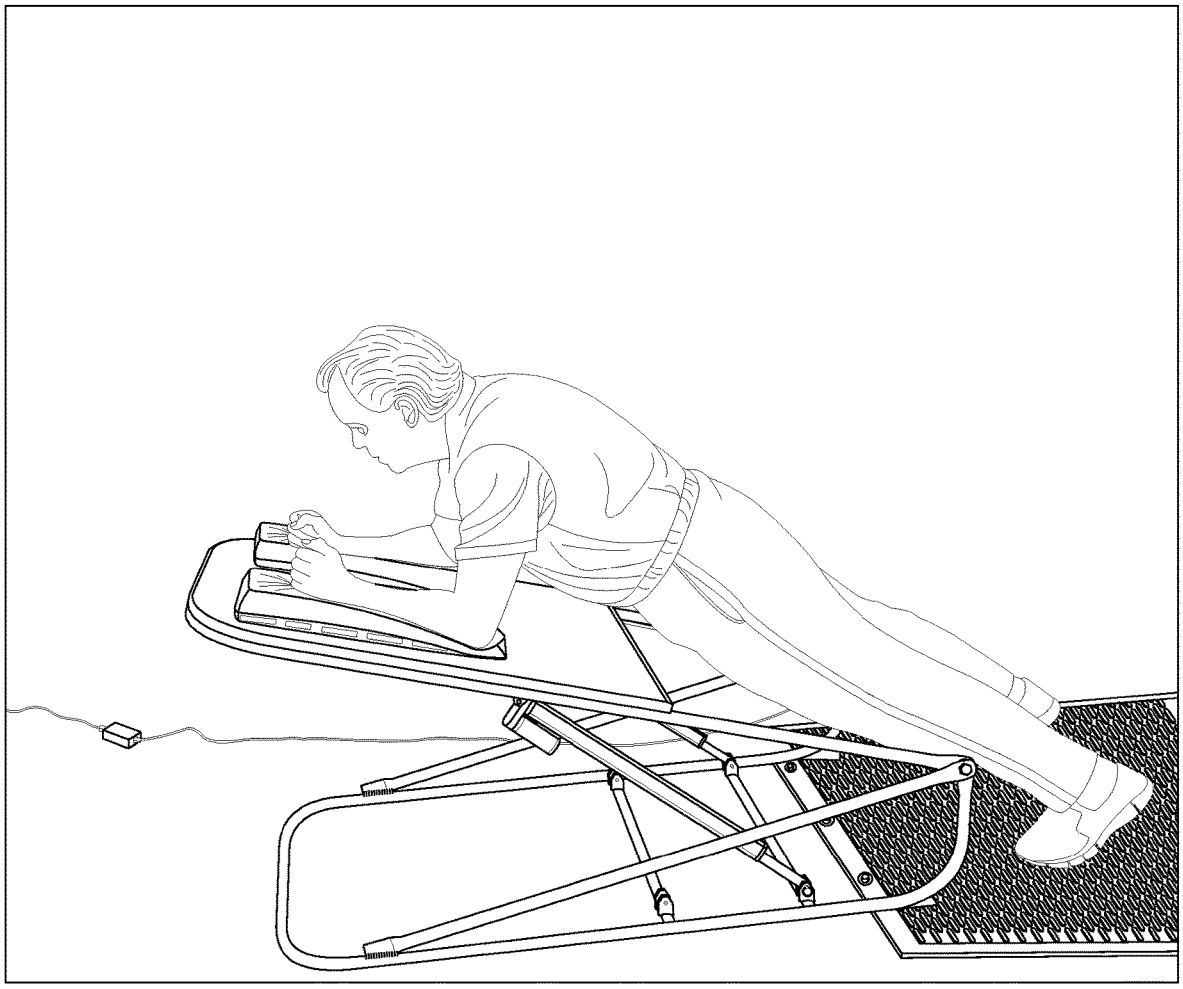
FIGS. 12, 13, 14 and 15 show a user of the exercise device in its various configurations and with selected components.
Figure 15:
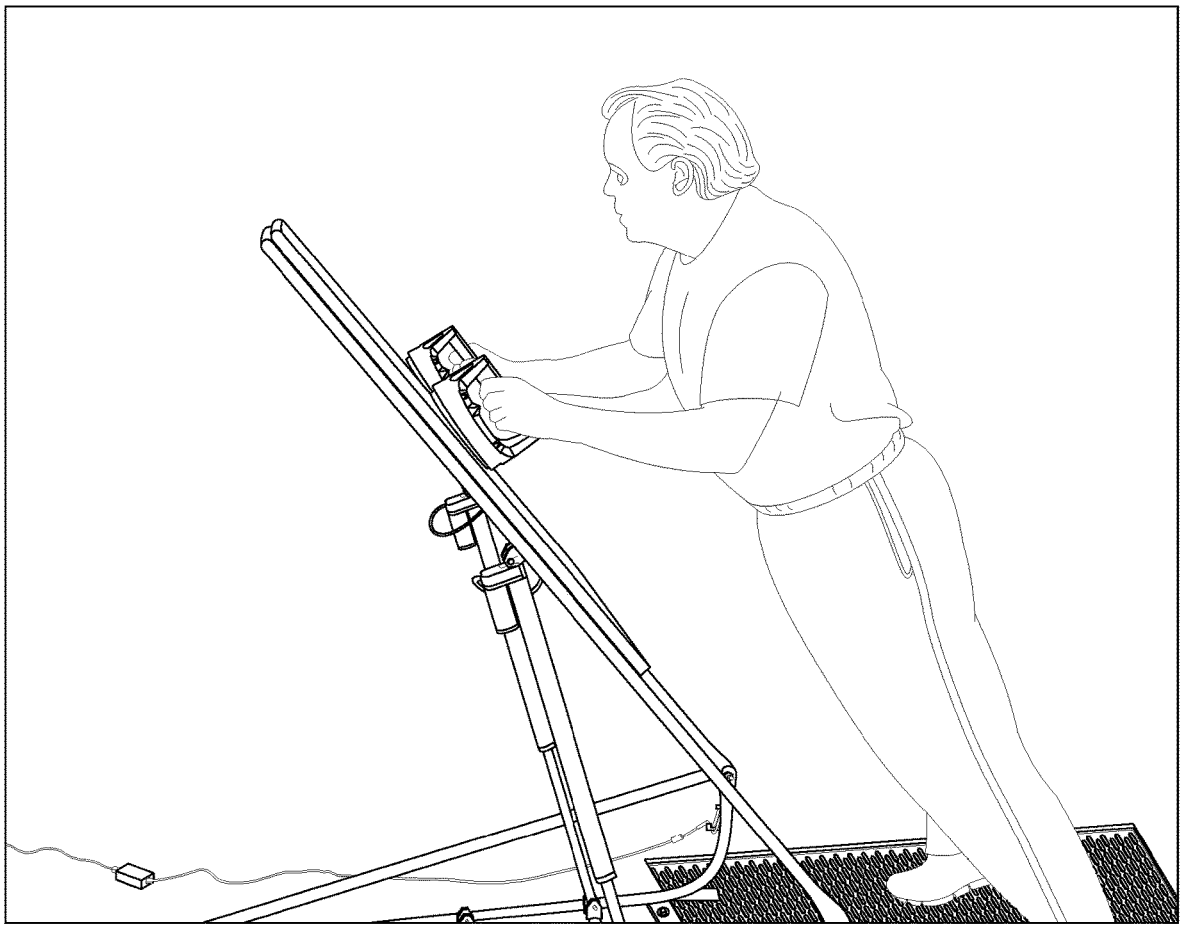
Figure 16:
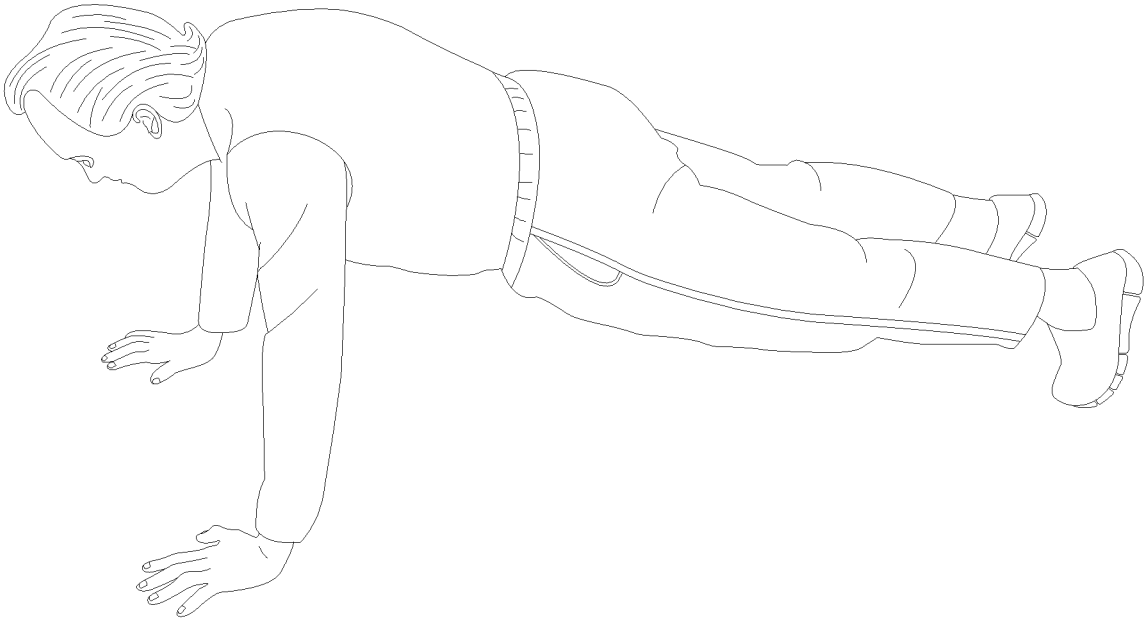
FIGS. 16 and 17 show a user doing push-ups and the plank in a traditional manner on a flat surface such as the floor.
Figure 17:
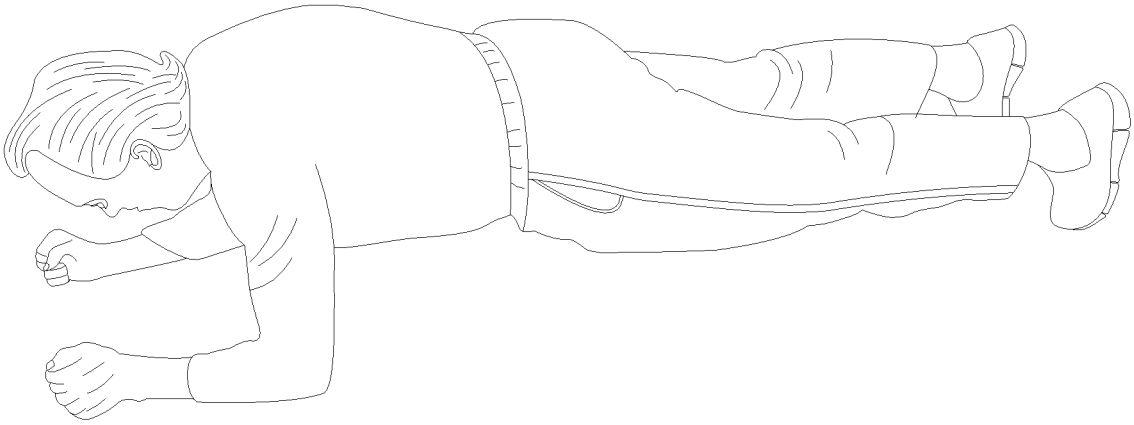

FIG. 12 of the drawings shows a user on the exercise device 10, wherein the upper frame 14 is in the near, but not complete, horizontal position. FIG. 13 shows a user on the exercise device 10, when the upper frame 14 is in a more or near vertical position, requiring less strength to perform exercise. In both of these figures, the forearms are flat on the platform, and rest on the armrest which provides for additional comfort. FIG. 12 shows a user doing a push-up, and also shows handles on the platform, when the upper frame 14 is in the near horizontal position. FIG. 15 shows the user performing push-ups, again holding onto the handles, but wherein the upper frame 14 is closer to the upright position, thus requiring less energy and strength. For comparative purposes, FIGS. 16 and 17 show a user respectively carrying out push up and plank exercises on a flat surface, which offers none of the advantages and benefits of the present invention, which allows for incremental bodily positioning based on the level of difficulty required by the user.

Figure 20:
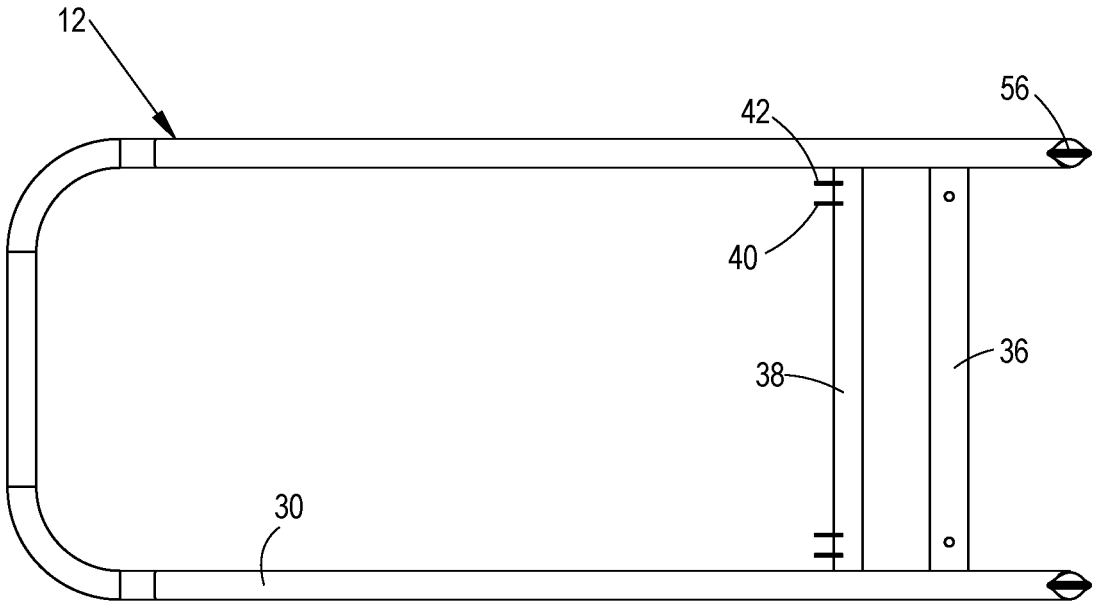
FIG. 20 is a top view of the lower frame of the exercise device.
Figure 21:
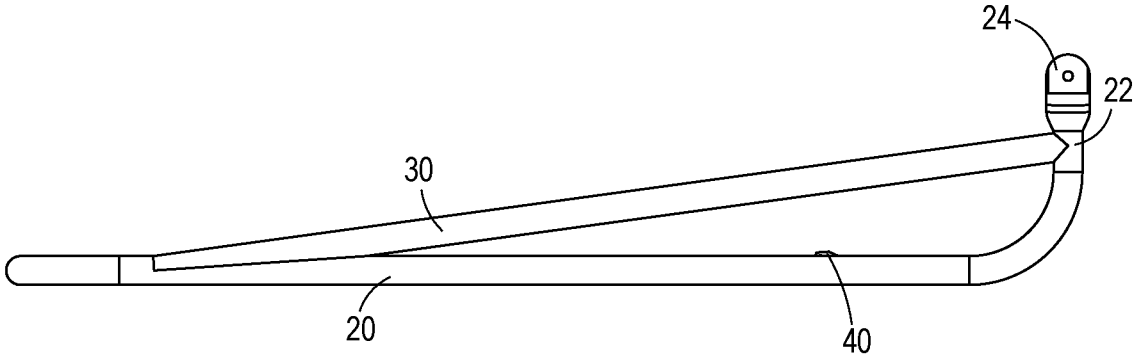
FIG. 21 is a side view of the lower frame illustrated in FIG. 20.
Figure 22:
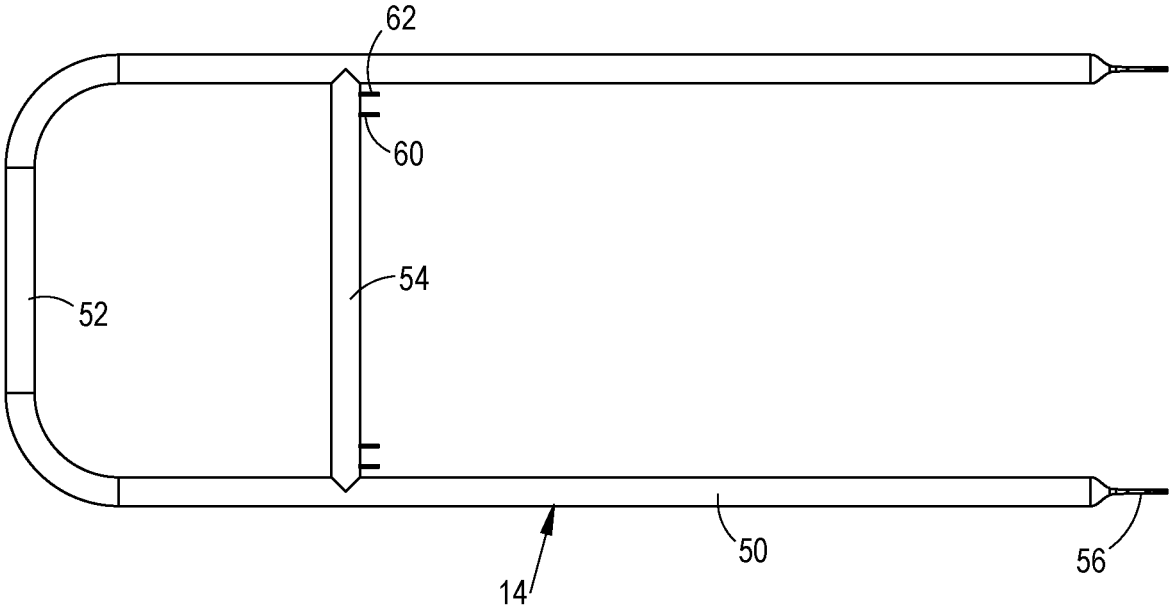
FIG. 22 is a top view of the upper frame of the exercise device.
Figure 23:
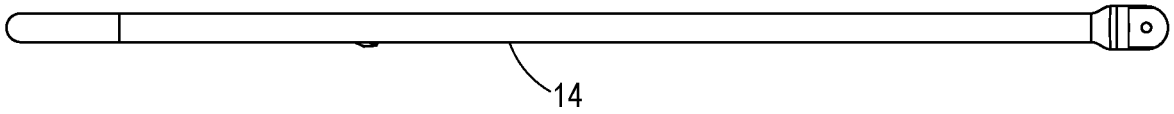
FIG. 23 is a side view of the upper frame illustrated in FIG. 22.

FIG. 20 of the drawings shows a top view of the lower frame, while FIG. 21 shows a side view of the lower frame 12, including the flattened end 24 and the aperture 26. In FIG. 22 of the drawings, there is shown a top view of the upper frame 14, while FIG. 23 shows a side view of the upper frame 14, including the flattened end 56 and the aperture 58.

Figure 24:
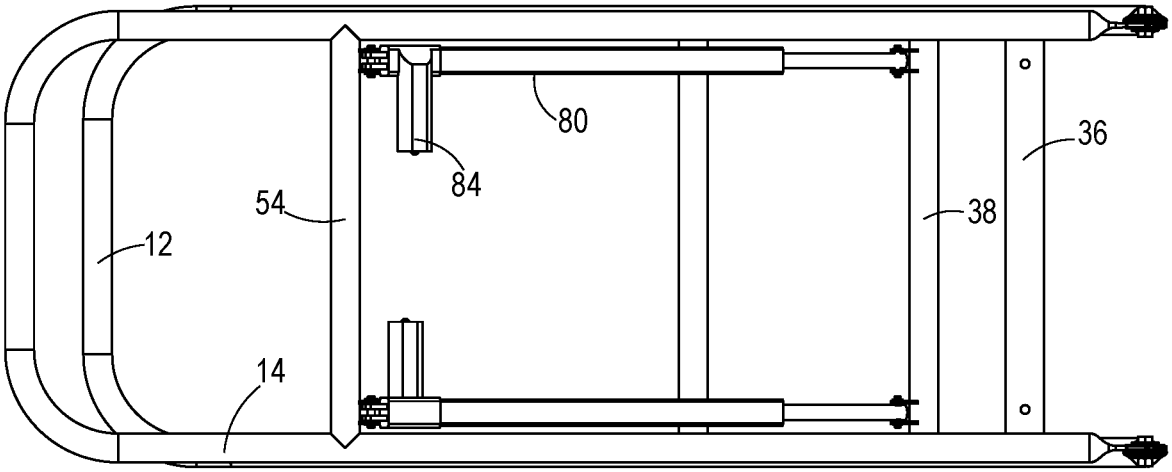
FIG. 24 is a top view of the exercise device, in a generally folded position.
Figure 25:
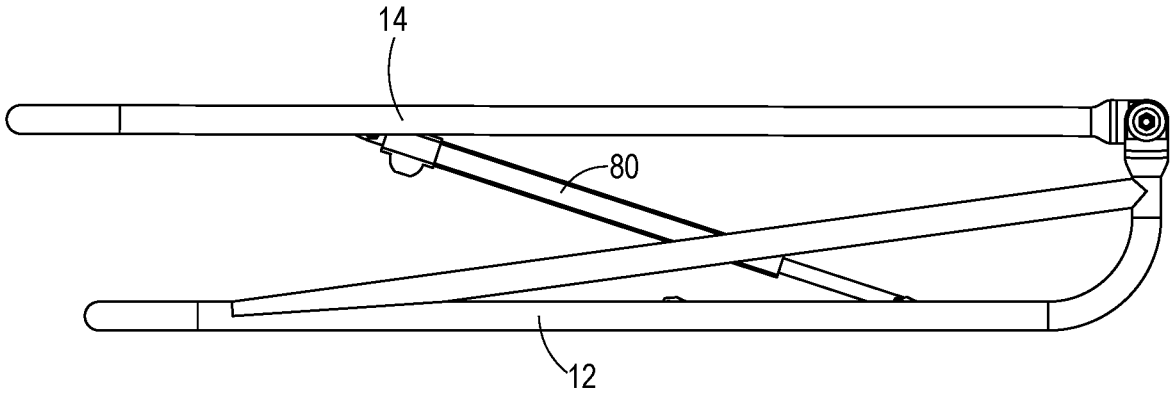
FIG. 25 is a side view of the exercise device illustrated in FIG. 24.
Figure 26:
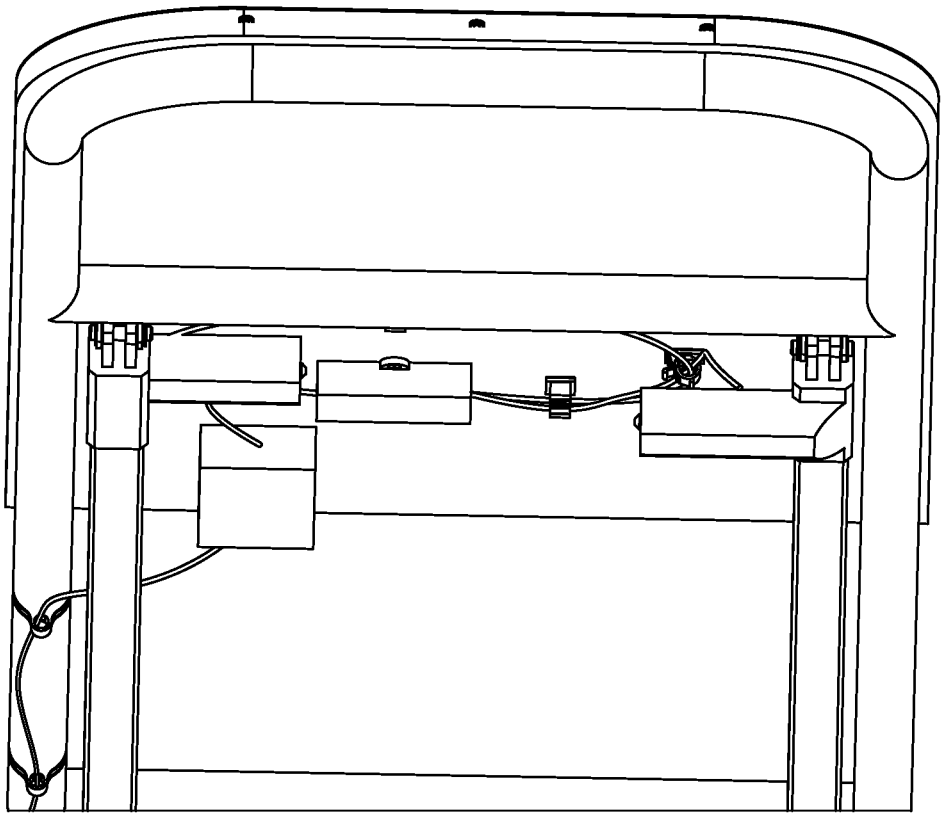
FIG. 26 is a view showing a vibration motor located on an exercise apparatus of the invention.

FIG. 24 of the drawings shows a top view of the exercise device 10, including all components thereof (but not a platform, which may be, in one embodiment, removed and installed as needed), with the exercise device 10 in the folded position such that the upper frame 14 is substantially horizontal and close to the lower frame 12. FIG. 25 of the drawings illustrates a side view of the exercise device 10 in accordance with the invention.

It will be appreciated that the present invention therefore provides an exercise device which incorporates flexibility and adjustability in order to take into account the relative strengths and levels of fitness of the user. Moreover, as the user becomes stronger and acquires greater levels of fitness, the exercise device 10 of the invention can be adjusted so that it provides a more challenging piece of exercise equipment for the user. As such, the exercise apparatus 10 of the invention continues to be valuable, and can be adapted to grow with the increasing strength and fitness of the user. The exercise device is suitable for both strong and well trained individuals, as well as those who are not as fit or may have a physical challenge or disability. The exercise device may, furthermore, be adjusted by a user who may move the upper frame to be more vertical or more horizontal while in the course of an exercise routine so that the exercise is varied in real time and changes to produce a varied workout procedure.

The invention is not limited to the precise details described and illustrated herein. Variations can be made, and still fall within the scope of the invention. For example, the device may be made of different types of materials. Further, it may have different dimensions and shapes of the frames than those illustrated. The importance of the invention resides in the ability to move an upper movable frame 14 relative to a lower fixed frame 12, in various increments, and preferably by a motorized operating device, so as to provide many options and choices for the user. The invention may also be manufactured so as to be sufficiently strong to handle the weight of a large person, or adapted to accommodate a person with certain disabilities. Further, while two actuators have generally been described, the invention is not limited to this arrangement. There may be only one actuator, or they may be more than two such actuators.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. An exercise apparatus comprising:

a base frame having a U-shaped configuration including a first lateral component, a second lateral component and a transverse component, the base frame having a base frame connector on each of the first lateral component and the second lateral component at an end thereof opposite the transverse component, the base frame comprising a vertical post extending upwardly from each ends of the first and second lateral components, the base frame connector being located at each of the ends;

a movable frame having a U-shaped configuration including a first lateral component, a second lateral component and a transverse component, the movable frame having a movable frame connector on each of the first lateral component and the second lateral component thereof at an end opposite the transverse component, each of the movable frame connectors being connected to one of the base frame connectors such that the movable frame is rotatable relative to the base frame, and an open space is provided between the base frame connectors on the first lateral component and second lateral component respectively;

an actuator located between the base frame and the movable frame, the actuator moving the movable frame relative to the base frame about the base frame connector so as to position the movable frame relative to the base frame in a selected position; and a platform mounted into a fixed position on the movable frame between the first lateral component and the second lateral component thereof, the platform comprising a leaning surface for a user of the exercise apparatus.

2. The exercise apparatus as claimed in claim 1, wherein the actuator comprises a telescoping extender positioned between the movable frame and the base frame, the actuator comprising a housing and a telescoping portion which selectively projects from or is contained within the housing, and wherein the position of the telescoping portion relative to the housing determines the angular position of the movable frame relative to the base frame.

3. The exercise apparatus as claimed in claim 2 wherein the actuator is operated by a motor.

4. The exercise apparatus as claimed in claim 3 further comprising a remote control device for selectively activating the motor.

5. The exercise apparatus as claimed in claim 3 further comprising a power source for the motor, the power source being selected from a battery, an external AC power source, or a combination thereof.

6. The exercise apparatus as claimed in claim 1 further comprising at least one arm rest mounted on the platform.

7. The exercise apparatus as claimed in claim 6 wherein the at least one arm rest is attached using hook and loop fastener.

8. The exercise apparatus as claimed in claim 1 further comprising at least one handle mounted on the platform.

9. The exercise apparatus as claimed in claim 8 wherein the at least one handle is mounted using hook and loop fastener.

10. The exercise apparatus as claimed in claim 1, wherein the base frame further comprises a front cross piece near the ends of the first and second lateral components, and an intermediate cross piece, the actuator being connected to the base frame at the intermediate cross piece thereof.

11. The exercise apparatus as claimed in claim 1, wherein the movable frame comprises a cross piece extending across the movable frame, the actuator being connected to the movable frame at the cross piece thereof.

12. The exercise apparatus as claimed in claim 1 further comprising a mat for positioning adjacent the exercise apparatus, and connection means for releasably securing the mat to the base frame of the exercise apparatus.

13. The exercise apparatus as claimed in claim 1 wherein the movable frame is configured to be angularly positioned and fixed at a selected angle relative to the base frame.

14. The exercise apparatus as claimed in claim 1, further comprising a vibration motor.

15. A method of exercising comprising:

locating, on a surface, a base frame having a U-shaped configuration including a first lateral component, a second lateral component and a transverse component, the base frame having a base frame connector on each of the first lateral component and the second lateral component at an end thereof opposite the transverse component;

providing, on the base frame, a movable frame having a U-shaped configuration including a first lateral component, a second lateral component and a transverse component, the movable frame having a movable frame connector on each of the first lateral component and the second lateral component thereof at an end opposite the transverse component, each of the movable frame connectors being connected to one of the base frame connectors such that the movable frame is rotatable relative to the base frame, and providing an open space between the base frame connectors on the first lateral component and second lateral component respectively;

operating an actuator located between the base frame and the movable frame for moving the movable frame relative to the base frame about the base frame connector so as to position the movable frame relative to the base frame in a selected initial position;

standing adjacent the movable frame, leaning on the platform and keeping feet of the user on the surface; and activating the actuator to move the movable frame relative to the base frame from the initial position through a motion cycle.

16. The method as claimed in claim 15 wherein the initial position selected is one in which the movable frame is in a near vertical position, and the motion cycle comprises movement of the movable frame from the initial position, to a near horizontal position, and back to the initial position.

17. An exercise apparatus comprising:

a base frame having a U-shaped configuration including a first lateral component, a second lateral component and a transverse component, the base frame having a base frame connector on each of the first lateral component and the second lateral component at an end thereof opposite the transverse component;

a movable frame having a U-shaped configuration including a first lateral component, a second lateral component and a transverse component, the movable frame having a movable frame connector on each of the first lateral component and the second lateral component thereof at an end opposite the transverse component, each of the movable frame connectors being connected to one of the base frame connectors such that the movable frame is rotatable relative to the base frame, and an open space is provided between the base frame connectors on the first lateral component and second lateral component respectively;

an actuator located between the base frame and the movable frame, the actuator moving the movable frame relative to the base frame about the base frame connector so as to position the movable frame relative to the base frame in a selected position, wherein the actuator is operated by a motor and includes a remote control device for selectively activating the motor; and a platform mounted into a fixed position on the movable frame between the first lateral component and the second lateral component thereof, the platform comprising a leaning surface for a user of the exercise apparatus.

* * * * *